US008161943B2

(12) United States Patent
Iwata et al.

(10) Patent No.: US 8,161,943 B2
(45) Date of Patent: Apr. 24, 2012

(54) NON-CONTACT IGNITION CONTROL DEVICE OF INTERNAL COMBUSTION ENGINE

(75) Inventors: Masao Iwata, Yokosuka (JP); Shigeyuki Suzuki, Yokosuka (JP); Kohsuke Watanabe, Yokosuka (JP)

(73) Assignee: Oppama Industry Co., Ltd., Kanagawa (JP)

( * ) Notice: Subject to any disclaimer, the term of this patent is extended or adjusted under 35 U.S.C. 154(b) by 598 days.

(21) Appl. No.: 12/441,217

(22) PCT Filed: Sep. 5, 2007

(86) PCT No.: PCT/JP2007/067257

§ 371 (c)(1),
(2), (4) Date: Mar. 13, 2009

(87) PCT Pub. No.: WO2008/035567

PCT Pub. Date: Mar. 27, 2008

(65) Prior Publication Data

US 2010/0031918 A1 Feb. 11, 2010

(30) Foreign Application Priority Data

Sep. 20, 2006 (JP) ..... 2006-254116
Oct. 16, 2006 (JP) ..... 2006-280828

(51) Int. Cl.
*F02P 5/16* (2006.01)
*F02P 3/08* (2006.01)
*F02D 17/00* (2006.01)

(52) U.S. Cl. ..... 123/406.57; 123/198 DC; 123/601

(58) Field of Classification Search ..... 123/149 R, 123/149 A, 149 D, 198 DC, 406.56, 406.57, 123/596, 598, 599, 601, 630, 632; 315/209 DC; 307/10.6

See application file for complete search history.

(56) References Cited

U.S. PATENT DOCUMENTS

| | | | | |
|---|---|---|---|---|
| 4,658,200 | A * | 4/1987 | Kouge | 322/25 |
| 5,878,709 | A | 3/1999 | Andersson et al. | |
| 6,724,164 | B2 * | 4/2004 | Shimizu et al. | 318/282 |
| 7,156,075 | B2 * | 1/2007 | Kiessling | 123/406.56 |
| 2006/0163879 | A1 | 7/2006 | Sekita et al. | |

FOREIGN PATENT DOCUMENTS

| | | |
|---|---|---|
| JP | 63-117168 | 5/1988 |
| JP | 64-003263 | 1/1989 |
| JP | 11-107895 | 4/1999 |
| JP | 11-153078 | 6/1999 |
| JP | 2000-240549 A | 9/2000 |
| JP | 2004-169615 | 6/2004 |
| JP | 2006-200474 | 8/2006 |

* cited by examiner

*Primary Examiner* — Willis Wolfe, Jr.
(74) *Attorney, Agent, or Firm* — Pillsbury Winthrop Shaw Pittman, LLP

(57) ABSTRACT

A no-contact ignition control device includes a stop switch which maintains a second switching element at the OFF state so that an induced voltage of a trigger coil triggers a first switching element and shortcircuit a generation coil. A surge absorption element is connected in parallel to the stop switch. This configuration prevents intrusion of a surge current into the ignition control circuit caused by static electricity accumulated on the surface of casing covering electronic parts of the ignition control circuit and surely avoid dielectric breakdown of the electronic parts or malfunction of the circuit by the surge current.

3 Claims, 4 Drawing Sheets

NON-CONTACT IGNITION CONTROL DEVICE OF INTERNAL COMBUSTION ENGINE

CROSS REFERENCE TO RELATED APPLICATIONS

This is the U.S. National Phase of PCT/JP2007/067257, filed Sep. 5, 2007, which in turn claims priority to. Japanese application nos. 2006-254116, filed Sep. 20, 2006 and 2006/280828, filed Oct. 16, 2006, the entire contents of all of which are incorporated herein by reference.

TECHNICAL FIELD

The present invention relates to a non-contact ignition control device of an internal combustion engine for leading the internal combustion engine to misfire control by operating a stop switch during operation of the internal combustion engine.

BACKGROUND ART

A non-contact ignition control device of an internal combustion engine has been proposed in which an operation of the internal combustion engine is continued through a spark generated at an ignition plug at a controlled predetermined timing on the basis of an induced electromotive force induced in synchronization with rotation of the internal combustion engine, while the internal combustion engine is led to misfire control by a stop-switch operation so as to automatically stop the internal combustion engine (Japanese Unexamined Patent Application Publication No. 2000-24054.9).

FIG. 6 is a block diagram conceptually illustrating such a related-art non-contact ignition control device of an internal combustion engine. In FIG. 6, a CDI-type ignition control circuit 52 and an ignition circuit 53 are connected in order to a generation coil 51, and a normally-open stop switch 54 is connected in parallel with the generation coil 51.

This stop switch 54 maintains an open state during operation of the internal combustion engine, and if the internal combustion engine is misfired and its operation is stopped, the switch is closed by manual operation. When the stop switch 54 is stopped, both terminals of the generation coil 51 are short-circuited, power supply to an ignition control circuit 52 and the like is stopped, and ignition of the internal combustion engine is also stopped.

The internal combustion engine is widely used as a power source for working machines such as a spraying machine, a pesticide spraying machine, a lawn mower and the like, and operation of the machines can be stopped by misfire control of the internal combustion engine by the ignition control circuit 52 at a closing operation of the stop switch 54.

In the above working machines, the stop switch 54 is provided together with a pump in the spraying machine, a blower in the pesticide spraying machine, a rotary blade in the lawn mower and the like at a position such that it can be stopped by hand, away from the generation coil 51.

The generation coil 51, the ignition control circuit 52 and the like might be made into a resin mold for the purpose of size reduction and unit formation of the non-contact ignition device of the internal combustion engine and housed in a plastic casing with a part of or the whole of a main body of the spraying machine and the like.

The stop switch 54 and a part of wiring that connects the stop switch 54 are installed outside the casing in order to enable a switching operation. Thus, at least a terminal (connector terminal in general) of the stop switch 54 is exposed to the outside of the casing.

DISCLOSURE OF INVENTION

However, with such a prior-art non-contact ignition control device of the internal combustion engine, the stop switch 54 is in an open state during operation of the internal combustion engine of the above working machine, and static electricity accumulated on the surface of the casing might jump to a terminal of the stop switch 54 or the wiring connected to the terminal. In this case, the static electricity becomes surge current and flows into the generation coil 51 and electronic components in the ignition control circuit 52 and might cause breakdown or malfunction.

In order to cope with this, a non-contact ignition control device in which a surge absorbing element 55 is connected to the stop switch 54 in parallel as shown in FIG. 7 can be considered. According to the non-contact ignition control device, even if the static electricity or static noise or electromagnetic noise from the outside jumps to the terminal of the stop switch 54 or the wiring, the surge absorbing element 55 absorbs (blocks) the advance of a surge current caused by the noise and prevents breakdown or malfunction of the generation coil 51 and the electronic components.

However, with the non-contact ignition control device of the internal combustion engine as shown in FIG. 7, there is a need to connect the surge absorbing element 55 for a high voltage, that is, with a high withstand voltage value, to the stop switch 54 in parallel in order to protect the generation coil 51 and the electronic components. Thus, the size of the surge absorbing element 55 is increased, and there is a problem that reduction in size of the ignition control circuit and the entire non-contact ignition control device is prevented and cost-cutting can not be achieved.

The present invention was made in order to solve the above existing problems and has an object to provide a non-contact ignition control device of an internal combustion engine that can prevent intrusion of a surge current into the ignition control circuit and the like when the static electricity accumulated on the casing surface covering the electronic components of the non-contact ignition control circuit and the like jumps to the stop-switch terminal and the wiring and can assuredly avoid breakdown of the electronic components and malfunction of the circuit by the surge current with a surge absorbing element with a small capacity.

In order to achieve the above object, in the non-contact ignition control device of the internal combustion engine according to the present invention having a generation coil that induces a voltage in synchronization with rotation of the internal combustion engine, an ignition control circuit that supplies an ignition voltage to an ignition coil of the internal combustion engine at a predetermined ignition timing on the basis of a voltage induced by the generation coil, and a stop switch operated to stop an operation of the internal combustion engine by misfire control, the ignition control circuit has a charging/discharging capacitor for ignition that charges a voltage induced by the generation coil and a switching element that discharges the charge accumulated in the charging/discharging capacitor and supplies it to the ignition coil, a surge absorbing element is connected in parallel with the stop switch, and when the switching element is ON by an ON operation of the stop switch, the generation coil is brought into a short-circuited state.

With the above configuration, in an operation state of the internal combustion engine with the stop switch in the open state, even if the static electricity accumulated on the casing surface jumps to the terminal of the stop switch or the wiring connecting the terminal to each electronic component of the ignition control circuit, a surge current based on the static electricity is prevented from flowing into the electronic components of the ignition control circuit on the low-voltage circuit side but can be earthed immediately. Thus, breakdown or malfunction of the electronic components can be avoided assuredly while a low-voltage and small-sized surge absorbing element with low cost is used.

Also, in the non-contact ignition control device of the internal combustion engine according to the present invention provided with a generation coil that generates an inductive electromotive force in synchronization with rotation of the internal combustion engine, an ignition control circuit that supplies an ignition voltage at a predetermined ignition timing to an ignition coil of the internal combustion engine on the basis of the inductive electromotive force induced by the generation coil, and a stop switch operated to stop operation of the internal combustion engine by misfire control, when the stop switch is connected between the ignition control circuit and the earth and is in a closed state, the internal combustion engine is made operable and when the switch is open-operated, the operation of the internal combustion engine can be stopped.

With the above configuration, in the operation state of the internal combustion engine with the stop switch in the closed state, even if the static electricity accumulated on the casing surface jumps to the terminal of the stop switch or the wiring connecting the terminal to the ignition control circuit as a surge (pulse-like high-level noise) current, the surge current can be earthed without having it flow into the generation coil or electronic components of the ignition control circuit. Thus, breakdown or malfunction of the generation coil or the electronic components can be avoided.

Also, the non-contact ignition control device of the internal combustion engine according to the present invention is characterized in that a surge absorbing element is connected to the stop switch in parallel.

With the above configuration, the noise generated during operation of the internal combustion engine can be absorbed by the surge absorbing element and after the open operation of the stop switch in order to stop the internal combustion engine, if the static electricity or noise intrudes into a connection terminal of the stop switch and the like during a predetermined period in which the internal combustion engine continues rotating, insulation of the generation coil and the electronic components of the ignition control circuit can be protected by absorbing the static electricity or noise, and security is maintained against static electricity.

According to the present invention, even if the static electricity accumulated on the main-body casing surface of a spraying machine and the like jumps to the terminal of the stop switch or the wiring connected to the stop switch during operation of the internal combustion engine, intrusion of the surge current based on the static electricity into the electronic components and the like of the ignition control circuit can be prevented, and breakdown or malfunction of the electronic components and the like can be prevented assuredly.

BEST MODE FOR CARRYING OUT THE INVENTION

Figure 1:
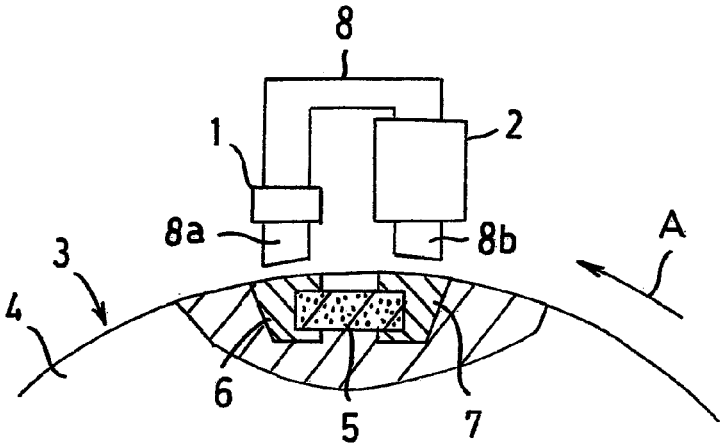
FIG. 1 is a partially broken front view of a non-contact ignition control device of an internal combustion engine according to the present invention.

An embodiment of a non-contact ignition control device of an internal combustion engine according to the present invention will be described referring to the attached drawings. In FIG. 1, a rotor 3 constituting the non-contact ignition control device of an internal combustion engine comprises a pair of magnetic poles 6, 7 embedded so as to sandwich a magnet 5 in a non-ferrous body 4 such as aluminum, for example. The magnetic poles 6, 7 are partially exposed to an outer circumferential face of the rotor 3 as shown in the figure so that they can oppose end faces of legs 8a, 8b of a U-shaped core 8 during rotation of the rotor 3.

Also, the legs 8*a*, 8*b* are wrapped with a generation coil 1 and a trigger coil 2, respectively. Opposing faces of the legs 8*a*, 8*b* to the rotor 3 are formed in an arc shape so as to maintain a distance to the rotor 3 constant.

The generation coil 1 is constituted so as to induce a high voltage from a need to charge a large capacity of ignition energy in a charging/discharging capacitor 10 for ignition. On the other hand, the trigger coil 2 is constituted to induce a low-level voltage for control so that the charging/discharging capacitor 10 for ignition is discharged instantaneously. Therefore, a withstand voltage of the electronic components of the ignition control circuit around the trigger coil 2 can be kept low.

Figure 2:
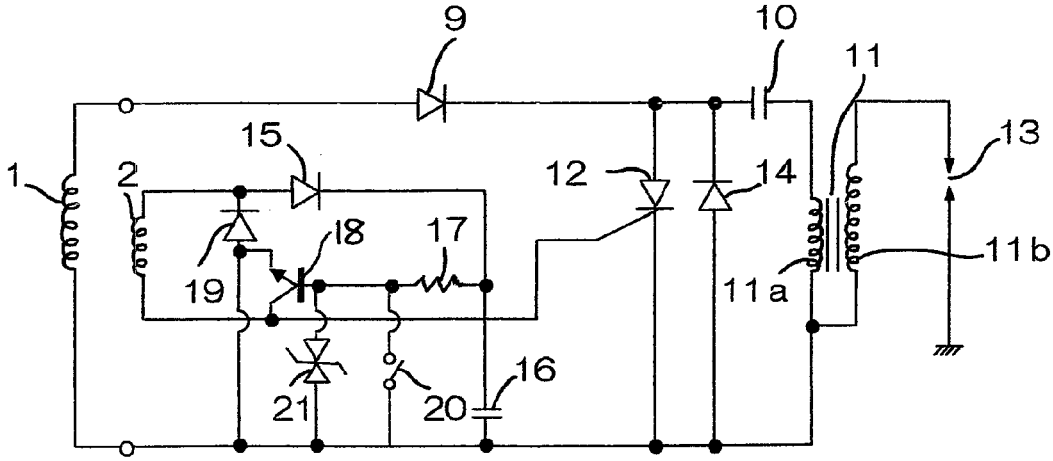
FIG. 2 is a circuit diagram illustrating an embodiment of the non-contact ignition control device of an internal combustion engine according to the present invention.

In FIG. 2, a diode 9, the charging/discharging capacitor 10 for ignition, and a primary coil 11*a* of the ignition coil 11 are connected in series to the generation coil 1, and they constitute a charging circuit for charging a positive voltage induced by the generation coil 1 to the charging/discharging capacitor 10 for ignition.

Also, the charging/discharging capacitor 10 for ignition is connected in series with the anode and cathode of a thyristor 12 as a first switching element and the primary coil 11*a* of the ignition coil 11, and they constitute a discharging circuit for discharging a charge of the charging/discharging capacitor 10 for ignition. The discharging circuit functions to emit the charge of the charging/discharging capacitor 10 for ignition to the. ignition coil 11 when the thyristor 12 is triggered and electrified.

To a secondary coil lib of the ignition coil 11, an ignition plug 13 is connected. Also, a diode 14 for LC oscillation on the primary side of the ignition coil 11 is connected between the anode and cathode of the thyristor 12. On the other hand, a diode. 15 and a capacitor 16 are connected in series between one end of the trigger coil 2 and the ground (earth).

One end of the capacitor 16 for trigger control is earthed, while to the other end, a base of a transistor 18 as a second switching element is connected through a resistor 17 forming a time-constant circuit together with the caoacutir. A collector of this transistor 18 is connected in the middle of a circuit connecting the other end of the trigger coil 2 and a gate of the thyristor 12.

An emitter of the transistor 18 is connected in the middle of a circuit connecting the one end of the trigger coil 2 and the diode 15 through the diode 19, a stop switch 20 is connected between the base of the transistor 18 and the earth, and to this stop switch 20, a surge absorbing element 21 is connected in parallel. As the surge absorbing element 21, a varistor, a Zener diode or the like is used, for example. For the stop switch 20 and the surge absorbing element 21, those available in the market with high general-purpose properties and low cost are used.

Next, an operation of the non-contact ignition control device will be described. First, when the internal combustion engine is driven, the rotor 3 is rotated in a direction of an arrow A in FIG. 1. Thereby, voltages with waveforms shown in FIGS. 3A and 3B are induced in the trigger coil 2 and the generation coil 1, respectively. In the induced voltage of the generation coil 1, a positive induced voltage is applied to the primary coil 11*a* of the ignition coil 11 through the diode 9 and the charging/discharging capacitor 10 for ignition. Thus, a charge is accumulated in the charging/discharging capacitor 10 for ignition. This charging voltage waveform is as shown in FIG. 3C.

On the other hand, the positive induced voltage in the induced voltage of the trigger coil 2 rises earlier than rise in the positive induced voltage of the generation coil 1 by a predetermined cycle t and charges the capacitor 16 for trigger control through the diode 15. The charging voltage waveform of the capacitor 16 for trigger control is shown in FIG. 3D.

Figure 3:
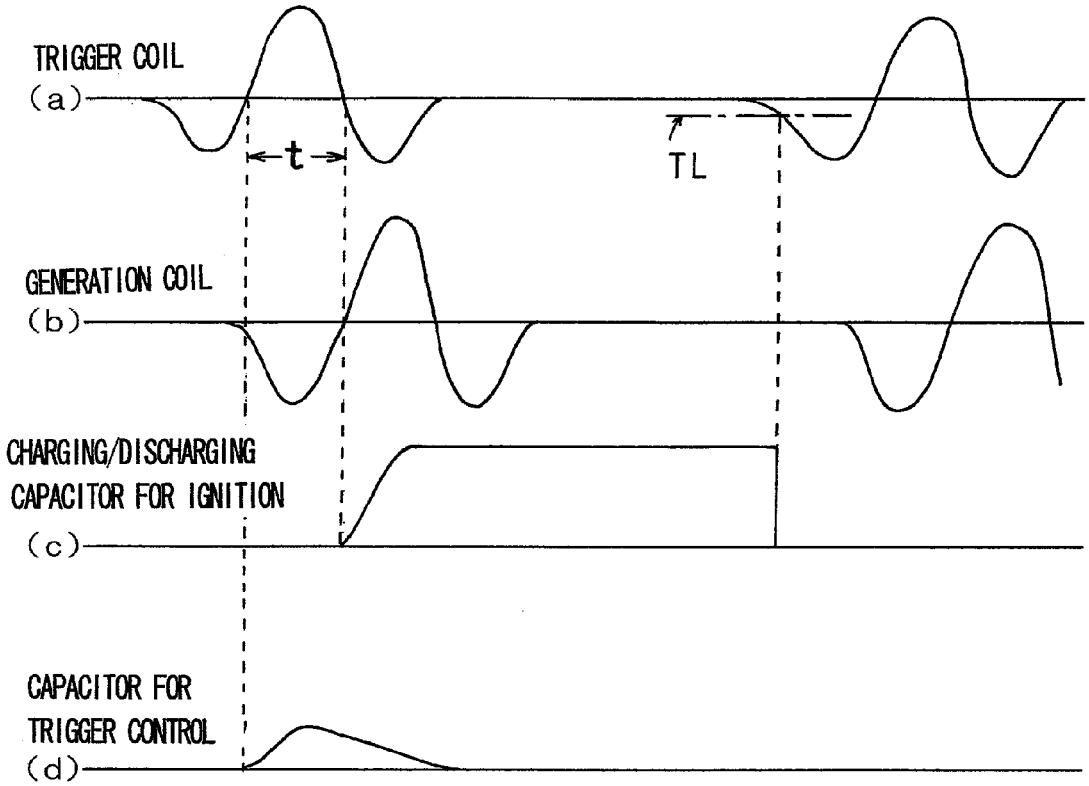
FIG. 3 is a timing chart illustrating voltage waveforms of each section in the circuit shown in FIG. 2.

Also, when a potential of the gate of the thyristor 12 reaches a set level, that is, when the induced voltage of the trigger coil 2 reaches a first trigger level TL shown in FIG. 3A after charging of the charging/discharging capacitor 10 for ignition, the thyristor 12 is turned ON. Thus, the charge of the charging/discharging capacitor 10 for ignition is supplied to the ignition coil 11 through the thyristor 12.

As a result, an ignition voltage is applied from the ignition coil 11 to the ignition plug 13, and a mixture in a combustion chamber in the internal combustion engine is ignited. By repetition of this operation, start of the internal combustion engine and the subsequent rise of rotation speed are promoted, and moreover, an advance angle of ignition timing increases horse power as an engine output.

Also, during a process in which the induced voltage of the trigger coil 2 is changed from positive to negative, the charge with the charging voltage waveform shown in FIG. 3D accumulated in the capacitor 16 for trigger control is discharged through the resistor 17 constituting a time-constant circuit together with the capacitor 16 for trigger control. Thus, the transistor 18 is turned ON. As a result, the trigger current having flown through the trigger coil 2, the gate/cathode of the thyristor 12, and the diode 19 is shunted by turning-on of the transistor 18 for a predetermined time period of discharge of the capacitor 16 for trigger control. During this period, trigger of the thyristor 12 is prohibited and brought into the off state.

Therefore, the shunt of the trigger current by turning-on of the transistor 18 continues till a point of time when the induced voltage of the trigger coil 2 reaches the subsequent trigger level TL if the internal combustion engine is rotated at a high speed exceeding a normal rotation speed set in advance. Therefore, the subsequent trigger of the thyristor 12 is avoided, and a delay angle of the ignition timing is started. That is, if the rotation speed of the internal combustion engine exceeds the normal rotation speed, the ignition timing is gradually delayed, and as a result, excessive rotation of the internal combustion engine can be prevented.

On the other hand, in the above operation of the non-contact ignition control device, the stop switch 20 maintains the OFF state. Then, if the operation of the working machine having the internal combustion engine is to be stopped, the stop switch 20 is on-operated. With this operation, the induced voltage of the trigger coil 2 continues flowing to the gate and the cathode of the thyristor 12 through the stop switch 20. During this time, the thyristor 12 is brought into the ON state, and both ends of the generation coil 1 are shunted. Thus, the internal combustion engine is brought into a misfire state and stopped.

The stop switch 20 is mounted on an end of a support member away from the rotary blade or a blower of a chain saw or spraying machine in order to enable the above operation at hand. Also, the stop switch 20 is provided outside a casing surrounding the generation coil 1, the trigger coil 2, the ignition control circuit and the like, which are resin-molded. Thus, the static electricity accumulated on the casing surface jumps to the stop switch 20 and a part of the wiring connected to the stop switch 20.

In this case, the static electricity becomes a surge current and tries to flow into the generation coil 1 and the electronic components in the ignition control circuit, but the surge absorbing element 21 connected in parallel with the stop switch 20 absorbs the surge current. Thus, breakdown or malfunction of the electronic components caused by the surge current can be avoided assuredly.

In this embodiment, the stop switch 20 is installed at the ignition control circuit operating with a relatively low voltage induced by the trigger coil 2 as its power source. Thus, the surge current on the current flowing through the stop switch 20 and the wiring connected to this also becomes relatively low level. Therefore, as the surge current absorbing element absorbing the surge current, those with a low withstand voltage can be used.

Therefore, as the surge absorbing element 21 with a low withstand voltage, those having a markedly smaller size and higher general-purpose properties and less expensive than the existing ones connected in parallel with the generation coil 1 can be used. Thus, mounting on an ignition control circuit board is facilitated, and the size of the entire device can be reduced.

This embodiment has a configuration in which the induced voltage of the generation coil 1 is applied to the charging/discharging capacitor 10 for ignition, the charge accumulated in the charging/discharging capacitor 10 for ignition is discharged by a trigger of the switching element 12 and supplied to the ignition coil 11, the switching element 12 is turned ON and the generation coil 1 is made capable of short-circuit at the on-operation of the stop switch 20 connected to the trigger circuit of the switching element 12, and the surge absorbing element 21 is connected in parallel with the stop switch 20.

As a result, in the operation state of the internal combustion engine with the stop switch 20 in the open state, even if the static electricity accumulated on the casing surface jumps to the terminal of the stop switch 20 or the wiring connecting the terminal to the ignition control circuit as a surge current, the surge current can be earthed immediately without having it flow into the electronic components of the ignition control circuit on the low-voltage circuit side. As a result, breakdown or malfunction of the electronic components can be assuredly avoided while the low-voltage, small-sized and low-cost surge absorbing element 21 is used.

Figure 4:
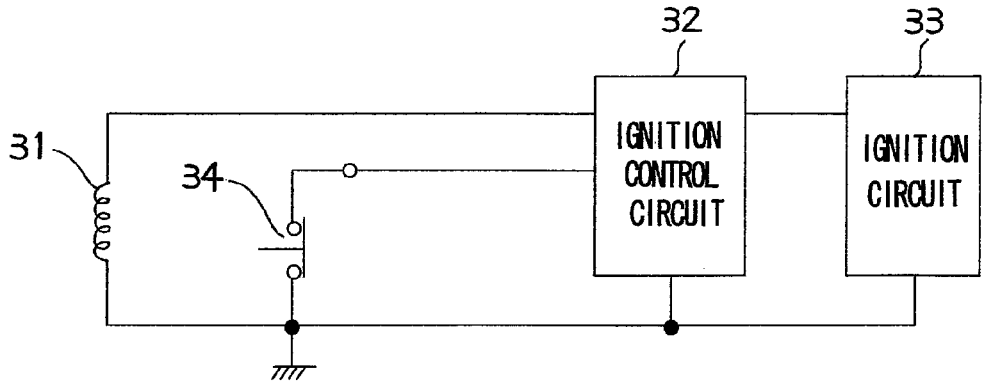
FIG. 4 is a block diagram illustrating another embodiment of the non-contact ignition control device of an internal combustion engine according to the present invention.

FIG. 4 is a block diagram illustrating another embodiment of the non-contact ignition control device of an internal combustion engine according to the present invention. In this figure, the non-contact ignition control device of an internal combustion engine is provided with a generation coil 31, an ignition control circuit 32, an ignition circuit 33, and a stop switch 34.

According to the non-contact ignition control device of an internal combustion engine, in the operation state of the internal combustion engine, even if the static electricity accumulated on the surface of the casing and the like jumps to the terminal and the like of the stop switch 34, a surge (current) caused by the static electricity can be immediately earthed. Therefore, intrusion of the surge current into the generation coil 31, the ignition control circuit 32 and the like can be prevented. As a result, breakdown or malfunction of the generation coil 31 and the electronic components constituting the ignition control circuit 32 can be avoided in advance.

In the non-contact ignition control device of an internal combustion engine, the generation coil 31 is a coil generating a voltage in synchronization with rotation of the internal combustion engine. The ignition control circuit 32 is connected to this generation coil 31, outputs an ignition control signal at a predetermined timing on the basis of the induced voltage of the generation coil 31 and enables application of a high voltage to an ignition plug (not shown) through an ignition coil (not shown) of the ignition circuit 33. Upon receipt of the high voltage, a spark is generated at the ignition plug, a mixture in a cylinder is ignited, and the internal combustion engine is made operable. As the ignition control circuit 32, a capacitor discharge type is used.

The stop switch 34 has one of its terminals connected to the ignition control circuit 32 and the other terminal connected to earth (earthed). Also, the stop switch 34 is closed and earthed during operation of the internal combustion engine. On the other hand, if the internal combustion engine is forced to misfire and stop, a route between the ignition control circuit 32 and the earth is opened by an open operation of the stop switch 34.

Therefore, in the non-contact ignition control device of an internal combustion engine according to this embodiment, even if the surge current caused by static electricity intrudes into the terminal of the stop switch 34 and the wiring connecting the stop switch 34 and the ignition control circuit 32 during operation of the internal combustion engine, the surge current is earthed. Thus, the surge current does not flow into the generation coil 31 or the ignition control circuit 32. Therefore, breakdown or malfunction of the generation coil 31 and the electronic components in the ignition control circuit 32 can be assuredly prevented.

Figure 5:
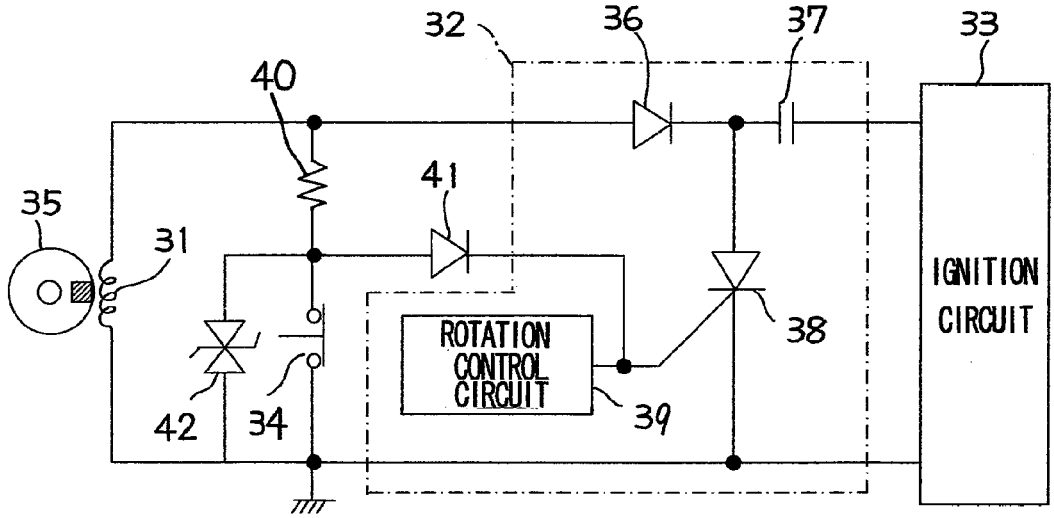
FIG. 5 is a circuit diagram illustrating a specific example of the non-contact ignition control device shown in FIG. 4.
Figure 6:
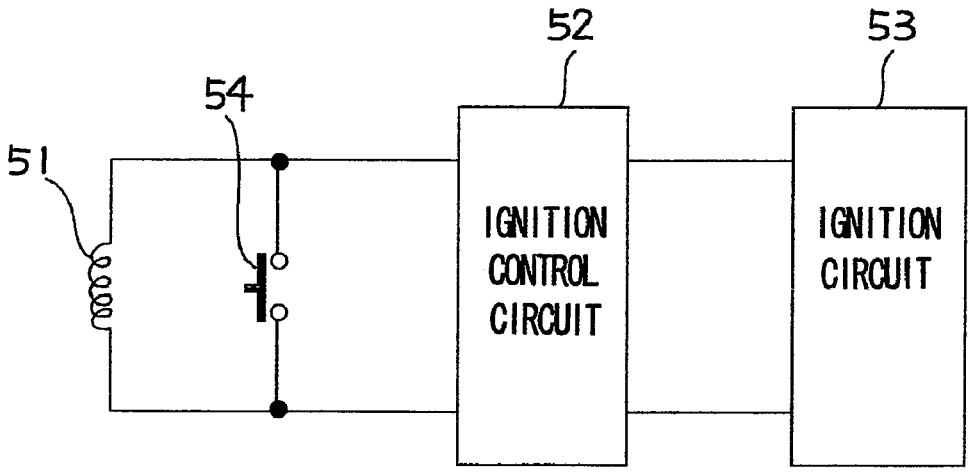
FIG. 6 is a block diagram illustrating a prior-art non-contact ignition control device of an internal combustion engine.
Figure 7:
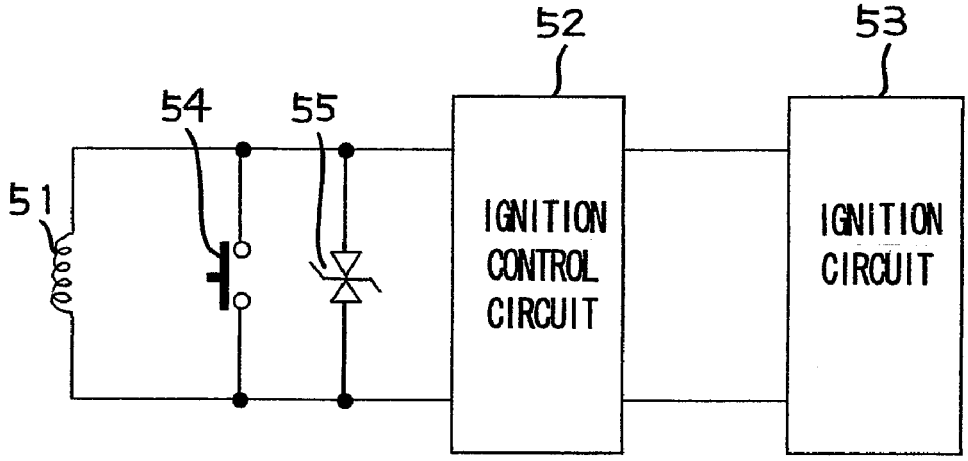
FIG. 7 is a block diagram illustrating another example of the prior-art non-contact ignition control device of an internal combustion engine.

FIG. 5 shows a more specific circuit diagram of FIG. 4. In FIG. 5, in the vicinity of the generation coil 31, a rotor 35 with a magnet mounted is oppositely arranged, and the generation coil 31 is wound around both legs of a U-shaped core. To the generation coil 31, a diode 36, a charging/discharging capacitor 37 for ignition, and a primary coil (not shown) of an ignition coil constituting the ignition circuit 33 are connected in series, and they constitute a charging circuit charging a positive voltage induced by the generation coil 31 to the charging/discharging capacitor 37.

The charging/discharging capacitor 37 for ignition is connected in series with the anode/cathode of a thyristor 38 as a switching element and the primary coil of the ignition coil, and they constitute a discharge circuit of the charging/discharging capacitor 37 for ignition.

Also, to a gate of the thyristor 38, a trigger circuit 39 is connected. According to this configuration, by triggering the thyristor 38 by an output of the trigger circuit 39, the charging/discharging capacitor 37 for ignition functions so as to discharge a charge to the ignition coil through the thyristor 38. To a secondary coil (not shown) of the ignition coil, an ignition plug is connected.

The trigger circuit 39 functions to supply a trigger signal to the thyristor 38 at an appropriate predetermined timing of the internal combustion engine. The diode 36, the charging/discharging capacitor 37 for ignition, the thyristor 38, and the trigger circuit 39 constitute the ignition control circuit 32.

Also, to the generation coil 31, a resistor 40 and a serial circuit made of the normally-closed stop switch 34 are connected in parallel. Between a connection point between the resistor 40 and the stop switch 34 and the gate of the thyristor 38, a backflow prevention diode 41 is connected. Moreover, a surge absorbing element 42 such as a varistor and a Zener diode is connected in parallel with the stop switch 34. One end of the stop switch 34 is earthed.

The stop switch 34 is closed during the operation of the internal combustion engine as mentioned above, and the open operation by a worker and the like is enabled in order to enable misfire control of the internal combustion engine.

The surge absorbing element 42 absorbs various noises generated during the operation of the internal combustion engine. Also, the surge absorbing element 42 functions to absorb surge or noise intruding into the terminal of the stop switch 34 and the wiring connected to the terminal against static electricity from a human body and the like during a period from the misfire of the internal combustion engine by the open operation of the stop switch 34 until rotation of the internal combustion engine has stopped and when the engine is in a stopped state.

In the non-contact ignition control device of an internal combustion engine, when the internal combustion engine is operated and the rotor 35 is rotated, voltages are induced at the generation coil 31 opposing the rotor 35 and a trigger coil (not shown) in the rotation control circuit 39, respectively. In the induced voltage of the generation coil 31, a positive voltage flows to the ignition coil (primary coil) in the ignition circuit 33 through the diode 36 and the charging/discharging capacitor 18 for ignition and charges the charging/discharging capacitor 37 for ignition.

On the other hand, when a trigger signal is inputted to the gate of the thyristor 38 from the trigger circuit 39, the thyristor 38 is turned on and supplies the charge of the charging/discharging capacitor 37 for ignition to the ignition coil of the ignition circuit 33. Thus, an ignition voltage is applied to the ignition plug through the secondary coil of the ignition coil, a mixture in a combustion chamber is ignited by a generated spark, and the rotation speed of the internal combustion engine is gradually increased.

In order to stop the internal combustion engine during the operation of the internal combustion engine as above, the stop switch 34 is open-operated. By this open operation, the positive voltage induced by the generation coil 31 is applied to the gate of the thyristor 38 through the resistor 40 and the backflow prevention diode 41. Thus, the thyristor 38 is brought into the ON state, both ends of the generation coil 31 are shunted, and charging from the generation coil 31 to the charging/discharging capacitor 37 for ignition is blocked. Thus, the internal combustion engine is immediately brought into a misfire state and rapidly stopped.

Also, in the working machine driven by the internal combustion engine, the static electricity accumulated on the casing surface of the working machine might jump to the terminal of the stop switch 34 or the wiring connected to the terminal during the operation of the internal combustion engine as mentioned above. This static electricity flows through the terminal of the stop switch 34 or the wiring as a surge current, but the surge current can be earthed from the earth section. Thus, the surge current can be effectively prevented from flowing into the generation coil 31 or the electronic components in the ignition control circuit 32, and breakdown or malfunction of them can be assuredly avoided.

Moreover, noise generated by the internal combustion engine itself during operation of the internal combustion engine or external noise might jump to the terminal of the stop switch 34 and the like, but the noise can be absorbed by the surge absorbing element 42. Therefore, malfunction or breakdown of the electronic components caused by the noise can be prevented.

If the internal combustion engine is stopped by the open operation of the stop switch 34, the internal combustion engine keeps on rotating by inertia for a predetermined time immediately after the open operation. Thus, the static electricity is considered to jump to the terminal of the stop switch 34 opened at this time. In this case, too, the surge current flowing to the terminal and the like can be absorbed by the surge absorbing element 42 and its flow into the ignition control circuit 32 can be prevented.

Though not shown, size reduction of the ignition control device by unitization can be achieved by realizing the ignition control circuit 32 using a microcomputer, incorporating the microcomputer in a molded product (digital coil) including the generation coil 31, and by externally providing the stop switch 34 and the surge absorbing element 42 on it. In this case, too, intrusion of the surge and noise from the terminal of the stop switch 34 into each part of the circuit can be prevented. The above point was described in the CDI-type ignition control device, but even in the ignition control device of a transistor igniter type and the like, it is obvious that an effect to prevent the breakdown or malfunction caused by the static electricity can be similarly obtained.

As mentioned above, this embodiment is provided with the generation coil 31 for generating an inductive electromotive force in synchronization with rotation of the internal combustion engine, the ignition control circuit 32 for supplying an ignition voltage at a predetermined ignition timing to the ignition coil of the internal combustion engine on the basis of the inductive electromotive force induced by the generation coil 31, and the stop switch 34 for stopping the operation of the internal combustion engine by misfire control, and this embodiment is configured such that the stop switch 34 is connected between the ignition control circuit 32 and the earth, the internal combustion engine is made capable of operation in the closed state, and the operation of the internal combustion engine is stopped by the open operation.

As a result, even if the static electricity accumulated on the casing surface jumps to the terminal of the stop switch 34 or the wiring connecting the terminal and the ignition control circuit 32 in the operation state of the internal combustion engine with the stop switch 34 in the closed state, the surge current generated by the static electricity is prevented from flowing into the generation coil 31 or the electronic components in the ignition control circuit 32 but can be earthed and lost. Thus, breakdown or malfunction of the generation coil 31 or the electronic components caused by the surge current can be avoided in advance.

The invention claimed is:

1. A non-contact ignition control device of an internal combustion engine having a generation coil that induces a voltage in synchronization with rotation of the internal combustion engine, an ignition control circuit that supplies an ignition voltage to an ignition coil of the internal combustion engine at a predetermined ignition timing on the basis of a voltage induced by the generation coil, and a stop switch operated to stop an operation of said internal combustion engine by misfire control, characterized in that said ignition control circuit has a charging/discharging capacitor for ignition that charges a voltage induced by said generation coil and a switching element that discharges a charge accumulated by the charging/discharging capacitor for ignition and supplies it to the ignition coil, and to said stop switch, a surge absorbing element is connected in parallel and when said switching element is turned on by an ON operation of said stop switch, said generation coil is brought into a short-circuited state.

2. A non-contact ignition control device of an internal combustion engine having a generation coil that induces a voltage in synchronization with rotation of the internal combustion engine, an ignition control circuit that supplies an ignition voltage to an ignition coil of the internal combustion engine at a predetermined ignition timing on the basis of a voltage induced by the generation coil, and a stop switch operated to stop an operation of said internal. combustion engine by misfire control, characterized in that when said stop switch is connected between said ignition control circuit and earth and is in a closed state, said internal combustion engine is made operable, while when the stop switch is open-operated, the operation of the internal combustion engine is made stoppable.

3. The non-contact ignition control device of an internal combustion engine according to claim 2, wherein a surge absorbing element is connected in parallel with said stop switch.

* * * * *